United States Patent [19]

Shew

[11] Patent Number: 4,934,164

[45] Date of Patent: Jun. 19, 1990

[54] CYLINDER LOCK

[76] Inventor: Ming-Chwan Shew, No. 881, Fl. 2-8, Chiu-ju I Rd., San-Min District, Kaohsiung, Taiwan

[21] Appl. No.: 364,390

[22] Filed: Jun. 12, 1989

[51] Int. Cl.[5] ..... E05B 29/00

[52] U.S. Cl. ..... 70/491; 70/409

[58] Field of Search ..... 70/490–493, 70/395, 402, 403, 404, 407, 409

[56] References Cited

U.S. PATENT DOCUMENTS

| | | | |
|---|---|---|---|
| 955,267 | 5/1910 | Hill | 70/491 X |
| 1,494,765 | 5/1924 | Barrett | 70/491 |
| 1,804,955 | 5/1931 | Schlumpf | 70/409 |
| 2,391,834 | 12/1945 | Johnstone | 70/491 |
| 2,431,894 | 12/1947 | Spain | 70/490 |
| 3,524,335 | 8/1970 | George | 70/491 |
| 4,622,834 | 11/1986 | Hughes | 70/404 X |
| 4,794,772 | 1/1989 | Falk et al. | 70/491 |
| 4,838,051 | 6/1989 | Yang | 70/491 X |
| 7,720,838 | 7/1929 | Iznaga | 70/491 |

*Primary Examiner*—Robert L. Wolfe
*Assistant Examiner*—Suzanne L. Dino
*Attorney, Agent, or Firm*—Sughrue, Mion, Zinn, Macpeak & Seas

[57] ABSTRACT

A cylinder lock includes a cylindrical shell housing a core assembly which is locked against rotation relative to the shell by means of axial locking pieces and radial tumbler pins. The locking pieces move to their unlocking positions when the outer peripheral grooves thereof are aligned circumferentially with the outer peripheral grooves of the core assembly. The inner distal end of the locking pieces does not extend into an axial central bore of the core assembly, thereby minimizing the risk of the lock being picked by an intruder.

2 Claims, 4 Drawing Sheets

CYLINDER LOCK

BACKGROUND OF THE INVENTION

This invention relates to a cylinder lock, and particularly to a cylinder lock which includes axially moved locking members and radially moved locking members and which is operated by a key having axially extending projections and radially extending projections.

Various cylinder locks exist in the art. Some of them include radially extending tumblers to lock a plug against rotation relative to a cylindrical housing. Some cylinder locks include locking pieces which lock a cylindrical plug against rotation relative to a cylindrical shell and which can be moved axially by means of a key to their unlocking position. Examples of the latter are described in U.S. Pat. Nos. 3,878,700, 2,391,834, 1,494,765, 2,557,028, and 3,408,840, Netherlandish Patent No. 6,701,370, and Italian Patent No. 685948.

U.S. patent application No. 697,297 which was filed by the inventor of this application and which is now abandoned, discloses a cylinder lock shown in FIG. 1. The lock includes a cylindrical shell 1', a core assembly 2', locking pieces 3' axially movable in the grooves of the core assembly 2', and radial tumbler pins 4'. Each locking piece 3 has an inward projection 31' to slide in each slot 21' of the core assembly 2'. The locking pieces 3' achieve their unlocking position when their peripheral grooves 32' are aligned circumferentially with the peripheral grooves 22' of the core assembly 2'. It was found by the applicant that such a lock can be picked easily by an intruder. This is because the projection 31' of the locking pieces can be moved not only inwardly, but also slightly laterally so that a person may easily feel whether or not the locking pieces are in their unlocking position. Therefore, it is desirable to provide an improvement for such a lock.

SUMMARY OF THE INVENTION

An object of the invention is to provide a cylinder lock of the type described above with an improvement in which the longitudinal locking pieces of the lock cannot be moved laterally so that a person cannot easily determine the unlocking position of the locking pieces.

Another object of the invention is to provide an improvement for a cylinder lock which includes both axially movable locking pieces and radial tumbler pins, wherein a plurality of arbitrary or false grooves are provided in the locking pieces for the purpose of creating confusion and difficulty in the surreptitious detection of the position of the locking pieces.

According to the present invention, a cylinder lock comprises a core assembly rotatably mounted in a cylindrical shell, the core assembly being constituted of a plurality of longitudinal core pieces which are arranged annularly in the cylindrical shell and spaced apart from one another to confine an axial central bore and a plurality of axial grooves extending radially from and communicated with the axial bore, each of the core pieces having an inner distal end to bound the axial central bore and twoopposite radial end faces to bound the axial grooves, each of the core pieces further having a first outer peripheral groove aligned circumferentially with the first peripheral grooves of other core pieces. Longitudinal locking pieces are inserted respectively in the axial grooves and are slideable therein between a locking position and an unlocking position, each of the longitudinal locking pieces having a second outer peripheral groove to be aligned circumferentially with the first outer peripheral grooves and the second outer peripheral grooves of other locking pieces when in the unlocking position, each of the longitudinal locking pieces having an inner distal end terminating at a location within each axial groove and outside the central bore.

An engaging means projects from the inner side of the wall of the cylindrical shell into the first outer peripheral grooves to prevent the core assembly from rotation when the second outer peripheral grooves are out of alignment with the first outer peripheral grooves. The cylindrical shell further has a plurality of first radial pin holes. The core assembly further has a plurality of second radial pin holes to be aligned respectively with the first radial pin holes. Tumbler pins are provided in the first and second pin holes so as to lock the core assembly against rotation. The tumbler pins and the longitudinal locking pieces are placed in the unlocking positions simultaneously when the lock is operated by a key. Moreover, the locking pieces are provided with radial grooves on the radial side faces thereof to make picking of the lock more difficult.

The exemplary preferred embodiment will be described in detail with reference to the following drawings, in which:

DETAILED DESCRIPTION OF THE PREFERRED EMBODIMENT

Figure 1:
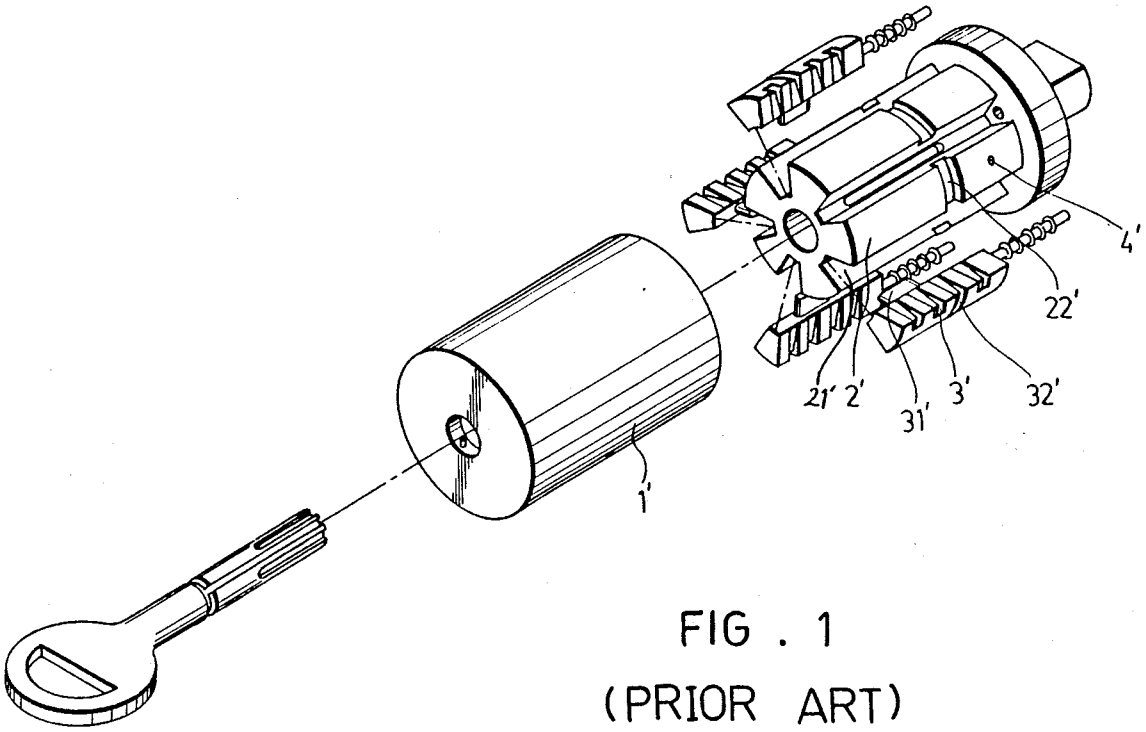
FIG. 1 (PRIOR ART)
FIG. 1 is a known cylinder lock.
Figure 2:
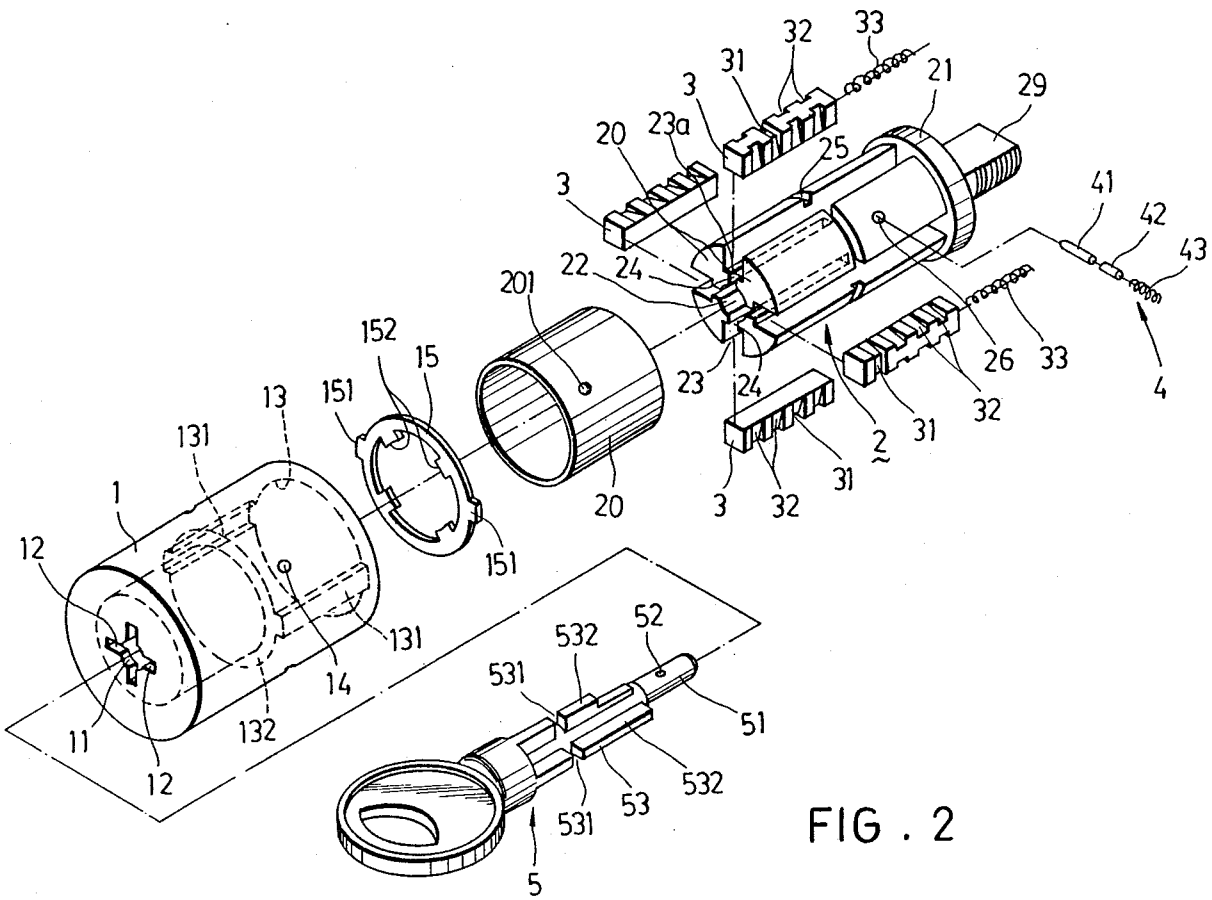
FIG. 2 is an exploded view of a cylinder lock according to the present invention.

Referring to the drawings, a cylindrical lock of the present invention is shown, including a cylindrical housing 1, and a core assembly 2 for rotation in the housing 1 incorporating four longitudinal locking members 3 and four tumbler pins 4. The cylindrical housing 1 confines a cylindrical bore and has an open end and a closed end, the closed end being provided with a key hole 11 having four radially extending portions 12. The cylindrical bore of the housing 1 has a portion 13 of enlarged cross-section, which opens at the open end of the housing 1. Two longitudinal grooves 131 are provided at diametrically opposite positions in the inner side of the wall of the portion 13 of the cylindrical housing 1. Radial holes 14 are provided in the wall of the housing 1.

An annular engaging plate 15 is inserted in the cylindrical bore of the housing 1 through the open end 13 of the cross-section portion and abuts with a shoulder formation 132 of the housing 1. Two diametrically opposite projections 151 of the the plate 15 engage with the grooves 131 of the housing 1, thereby preventing the plate 15 from rotation. The inner periphery of the annular plate 15 is provided with four projections 152 which extend inward radially. A sleeve member 20 is inserted in the enlarged cross-section portion of the bore of the housing 1 and sleeved around the core 2. Pin holes 201 are provided in the sleeve member 20 to be aligned with radial pin holes 26 of the core assembly 2.

The core assembly 2 includes four core pieces 20 which are spaced apart and arranged annularly to confine a central axial bore 22 and four axial grooves 23 which extend radially from the bore 22 so as to receive four longitudinal locking members 3. The core pieces 20 are connected integrally with an end piece 21 which has a shaft 29. Each axial groove 23 is communicated with the central axial bore 22 through a restricted axial passage 24. The inner distal ends of the core pieces 20 bound the central bore 22. The opposite radial end faces of the core pieces are stepped and bound the axial grooves 23 and restricted passages 24. On the outer peripheries of the core pieces 20 are provided peripheral grooves 25 to receive the projections 152 of the engaging plate 15. Radial pin holes 26 are provided in the core pieces 2 to be aligned with the pin holes 201 of the sleeve and the pin holes 14 of the housing 1. The holes 26 are communicated with the central bore 22 of the core assembly 2.

Tumbler pin assemblies 4 are provided in the core assembly and the housing 1. Each assembly has a pin segment 41, à pin segment 42 and a spring 33 which urges the pin segment 41 to the locking position.

Longitudinal locking pieces 3 are inserted respectively in the axial grooves 23. Each longitudinal locking piece 3 has only one outer peripheral unlocking groove 31 to be aligned circumferentially with the outer peripheral grooves 25 of the core pieces and with the outer peripheral unlocking grooves 31 of the other locking pieces 3 when in the unlocking position thereof. Each longitudinal locking piece has an inner distal end and is retained at a location within each axial groove 22 or outside the central bore 22, by engagement with shoulder formations **23*a* of the stepped radial end faces of the core pieces 20. The locking pieces 3 are further provided with arbitrary radial grooves 32 with arbitrary radial grooves 32 in the radial side faces thereof with a plurality or arbitrary or false radial grooves 32** whose function will be described hereinafter.

The key to be used with the lock of the present invention includes a front portion 51 which is provided with bosses 52 to press the pin segments 41 and a rear portion 53 which is provided with axially extending projections 532. The axial lengths of the projections 532 are different so that the locking pieces 3 are moved rearward through different predetermined distances to reach their respective unlocking positions corresponding to the respective axial positions of the unlocking grooves 31 along the length of the longitudinal locking pieces 3. When the key 5 is inserted into the bore 22 of the core, the projections 532 push the longitudinal locking pieces 3 to their different respective unlocking positions in which all the outer peripheral unlocking grooves 31 of the locking pieces are aligned circumferentially with the peripheral grooves 25 of the core pieces 2. Simultaneously, the bosses 52 push the tumblers respectively to their unlocking positions in which the interfaces of the pin segments 41, 42 are coplaner with the interface between the core pieces 2 and the inner side of the wall of the housing 1. In this situation, the core assembly 2 can be rotated with respect to the housing 1.

Figure 3:
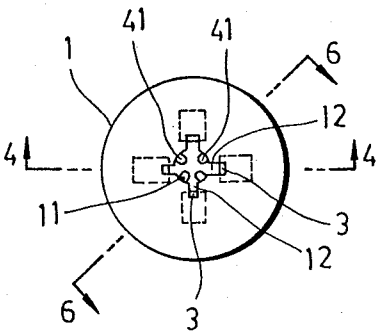
FIG. 3 is a front view of the cylinder lock of FIG. 2.
Figure 7:
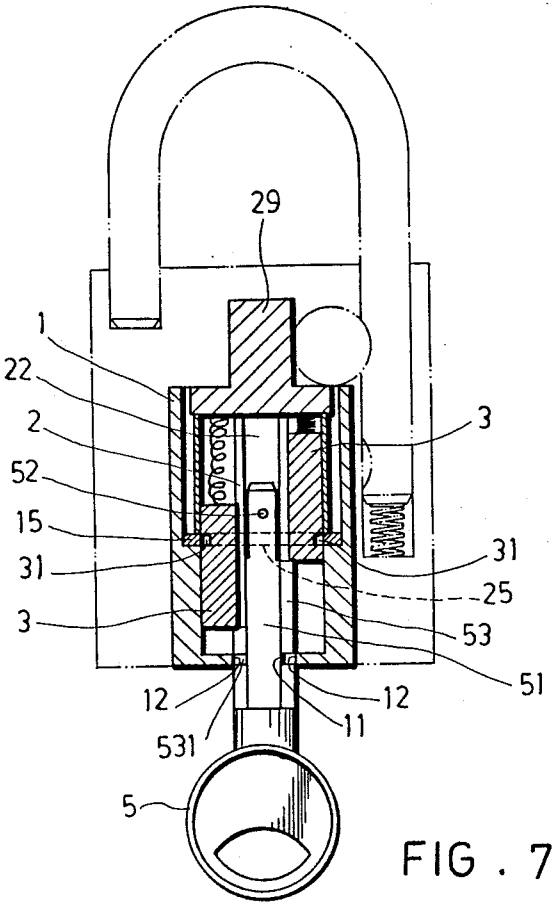
FIG. 7 is a sectional view of the lock during operation.
Figure 6:
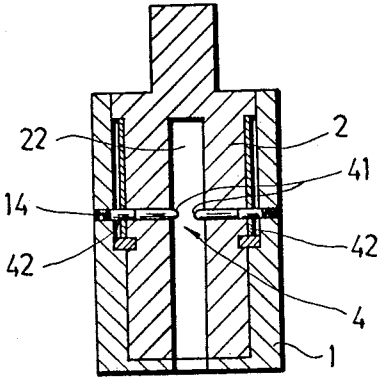
FIG. 6 is a sectional view taken along line 6—6 of FIG. 5.
Figure 5:
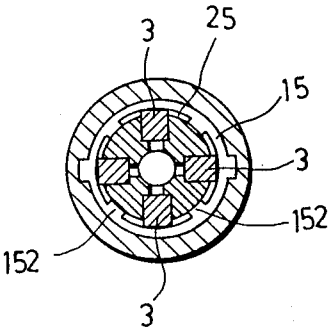
FIG. 5 is a sectional view taken along line 5—5 of FIG. 4.
Figure 4:
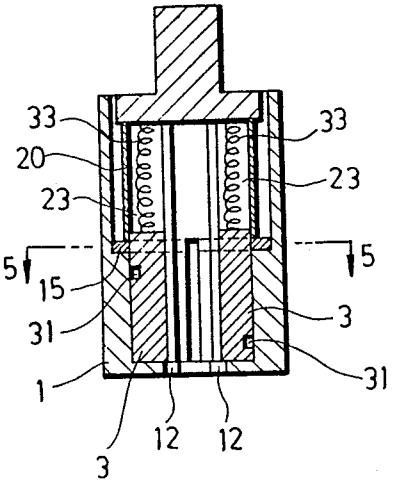
FIG. 4 is a sectional view taken along line 4—4 of FIG. 3.

The key 5 is further provided with transverse grooves 531 which will be aligned with the plane of the flange 10 of the housing 1 when the key 5 is inserted a proper distance into the bore 22 and the grooves 23. The flange 10 confines a central key access opening 11 aligned with the central bore 22 of the core assembly 2 and radially projecting access hole portions 12 in alignment with the axial grooves 23 of the core assembly 2, as shown in FIGS. 3 and 7. The projecting inner distal ends of the locking pieces 3 can be seen from the key access opening 11 and the radially projecting access hole portions 12, as shown in FIG. 3. When attempting to pick the lock of this invention, it will be found that, although the distal ends of the locking pieces 3 can be moved axially by an object other than the proper key, the locking pieces 3 are unable to be moved laterally or circumferentially within the grooves 23 so that it is impossible to determine by feel whether or not the locking pieces are in their unlocking positions.

The lock of the present invention is also effective to prevent surreptitious lock-picking operations because of the presence of the arbitrary or false radial grooves 32 on the locking pieces 3. It can be seen from FIG. 1 that only one of the radial grooves 32 of each locking piece 3 is aligned with the peripheral unlocking groove 31 of the locking piece 3. The object used for picking the lock may engage with any one of these radial grooves 32, thereby providing an element of confusion for the person who is picking the lock.

With the invention thus explained, it is apparent that various modifications and variations can be made without departing from the scope of the invention. It is therefore intended that the invention be limited only as indicated in the appended claims.

What I claim is:

1. A cylindrical lock comprising:

a cylindrical shell having a front end provided with a key hole, a core assembly for rotation in said shell, being constituted of a plurality of longitudinal core pieces which are arranged annularly in said cylindrical shell and spaced apart from one another to confine an axial central bore and a plurality of axial grooves extending radially from and communicated with said axial bore, each of said core pieces having an inner distal end to bound said axial central bore and two opposite radial end faces to bound said axial grooves, said radial end faces being stepped to provide shoulder formations, each of said core pieces further having only one outer peripheral first groove (25) aligned circumferentially with said only one outer peripheral first groove (25) of each of the other said core pieces;

longitudinal locking pieces inserted respectively in said axial grooves and slideable therein between a locking position and an unlocking position, each of said longitudinal locking pieces having only one outer peripheral second groove (31) to be aligned circumferentially with the outer peripheral first grooves (25) of said core pieces and with said only one outer peripheral second groove (31) of each of the other said locking pieces when in said unlocking position, each of said longitudinal locking pieces having an inner distal end engaging with said shoulder formations and prevented thereby from extending into said axial central bore; and an engaging means projecting from the inner side of the wall of said cylindrical shell into said outer peripheral first grooves (25) to prevent said core assembly from rotation when said outer peripheral second grooves (31) are out of alignment with said outer peripheral first grooves (25), radial side faces of each locking piece (3) having a plurality of radial third grooves (32), only one of which is aligned with said peripheral second groove (31) in said each locking piece, said cylindrical shell further having a plurality of first radial pin holes, said core assembly further having a plurality of second radial pin holes to be aligned respectively with said first radial pin holes, tumbler pins provided in said first and second pin holes so as to lock said core assembly against rotation, said tumbler pins and said longitudinal locking pieces being simultaneously placed in unlocking positions when the lock is operated by a key.

2. A cylinder lock as claimed in claim 1, wherein said second grooves (31) are located at respectively different axial positions along said longitudinal locking pieces.

* * * * *